US006442835B1

(12) United States Patent
Majewski et al.

(10) Patent No.: US 6,442,835 B1
(45) Date of Patent: Sep. 3, 2002

(54) CAMSHAFT FOR DECREASED WEIGHT AND ADDED WEAR RESISTANCE OF LOBE AREA

(75) Inventors: Thomas Majewski, Groveland; Michael J. Pollard, East Peoria, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/740,688

(22) Filed: Dec. 19, 2000

(51) Int. Cl.[7] ..... B21D 53/84

(52) U.S. Cl. ..... 29/888.1; 29/888.01; 123/90.6; 74/567

(58) Field of Search ..... 29/888.01, 888.1; 123/90.27, 90.31, 90.6; 74/567

(56) References Cited

U.S. PATENT DOCUMENTS

| | | | | |
|---|---|---|---|---|
| 3,704,746 A | | 12/1972 | Thompson | |
| 3,747,668 A | | 7/1973 | Schroll et al. | |
| 3,929,181 A | | 12/1975 | Beyer et al. | |
| 4,549,339 A | | 10/1985 | Lajoye | |
| 4,595,556 A | * | 6/1986 | Umeha | 419/8 |
| 4,614,225 A | | 9/1986 | Ernst et al. | |
| 4,652,724 A | * | 3/1987 | Morita | 219/121 LM |
| 4,804,033 A | | 2/1989 | Hepworth et al. | |
| 4,905,538 A | * | 3/1990 | Watanabe | 74/567 |
| 5,004,370 A | | 4/1991 | Swars | |
| 5,228,498 A | | 7/1993 | Harada et al. | |
| 5,778,530 A | * | 7/1998 | Nakamura | 29/888.1 |
| 6,171,713 B1 | * | 1/2001 | Smith | 428/614 |

FOREIGN PATENT DOCUMENTS

| | | | |
|---|---|---|---|
| JP | 5010417 | * | 1/1993 |

* cited by examiner

*Primary Examiner*—Thomas Denion
*Assistant Examiner*—Jaime Corrigan
(74) *Attorney, Agent, or Firm*—Whitham, Curtis & Whitham, PLC

(57) ABSTRACT

A camshaft used in an internal combustion engine which has reduced weight and added wear resistance at a lobe of the camshaft. The camshaft is provided to add increased wear resistance and reduced weight to the internal combustion engine for increased efficiency of the internal combustion engine. The camshaft includes wear resistant material at the surface of the lobe of the camshaft. The wear resistant material is distributed on the outer surface of the lobe and incorporated into the base material.

20 Claims, 3 Drawing Sheets

CAMSHAFT FOR DECREASED WEIGHT AND ADDED WEAR RESISTANCE OF LOBE AREA

TECHNICAL FIELD

This invention relates generally to a camshaft and more particularly to a camshaft having reduced weight and added wear resistance at a plurality of lobe areas of the camshaft.

BACKGROUND

One such component of the internal combustion engine is a camshaft, which is rotated by the driving force of the crank shaft so as to open and close the intake and exhaust valves at a specified timing. In order to open and close the intake and exhaust valves, the camshaft includes cams, each having a lobe which contacts and lifts respective rocker arms of the intake and exhaust valves during rotation of the camshaft. However, it has been found that the extensive contact between the lobes of the camshaft and respective rocker arms of the intake and exhaust valves causes lobe wear due to fatigue from high contact stresses. This problem, in turn, results in camshaft failure or inefficiencies in the performance of the engine.

A camshaft failure includes cracking of the shaft of the camshaft or any components thereof such as the cam. This usually results in a catastrophic failure of the internal combustion engine. On the other hand, inefficiencies in the performance of the engine include improper contact between the lobe of the cam and the respective rocker arms of the intake and exhaust valves resulting in the respective intake and exhaust valves from properly or fully opening. This may result in poor air-to-fuel ratios or inadequate discharging of exhaust gases, both of which result in poor fuel consumption or rough engine performance. Improper discharging of the exhaust gases also results in carbon build-up on the cylinder walls, which may also lead to poor fuel consumption and the like.

Manufacturers of internal combustion engines are continuously seeking ways to improve the efficiency and reliability of the internal combustion engine. These efficiencies are typically provided by improving the efficiency and reliability of each component of the internal combustion engine, including the camshaft. With regard to the camshaft, manufacturers have attempted to reduce the weight of the camshaft as well as use different camshaft materials in order to add torsional strength to the shaft of the camshaft. Although manufacturers have made great strides in improvements to the camshaft over the years, manufacturers have not yet provided a reduced weight camshaft with wear resistant properties at the lobe of the camshaft. This is mainly due to the manufacturing processes used by manufacturers such as, for example, green sand casting or forging, which leads to non-uniformity of material distribution (i.e., dense materials migrating toward one side of the camshaft) as well as increased camshaft weight, both resulting in a decrease in the efficiency of the internal combustion engine.

U.S. Pat. No. 5,004,370 to Swars issued on Apr. 2, 1991 discloses a hollow shaft having drive elements (e.g., cams) with axially varied properties. The drive elements are secured on the hollow shaft by expansion of the hollow shaft, and includes a separate wear layer produced by an induction-hardened process. This separate wear layer, however, is not distributed throughout the drive elements, nor is it distributed within the hollow shaft. Accordingly, the apparatus of Swars has a tendency to wear during the use of the internal combustion engine, and does not appear to adequately withstand high torsional or contract stresses.

The present invention is directed to overcoming one or more of the problems as set forth above.

DISCLOSURE OF THE INVENTION

In one aspect of the present invention a camshaft is provided. The camshaft includes a shaft made of a base material. A cam is located on the shaft. A lobe projects from the cam and is partly composed of the base material and a wear resistant material distributed on the outer surface of the lobe.

In another aspect of the present invention, the camshaft includes a shaft and a cam located on the shaft. A lobe extends from the cam and is composed of a wear resistant material which is denser than a base material used for the composition of the shaft.

In still another aspect of the present invention, the camshaft is adapted for use in an internal combustion engine. The internal combustion engine includes a cylinder block having a cylinder. A piston assembly is located within the cylinder and a crankshaft is connected to the piston assembly. A valve assembly communicates with the cylinder. A camshaft opens the valve assembly and includes a shaft. A cam, having a lobe, is located on the shaft. The lobe is composed of wear resistant material which is more dense than a material used for the camshaft.

BEST MODE FOR CARRYING OUT OF THE INVENTION

Figure 2:
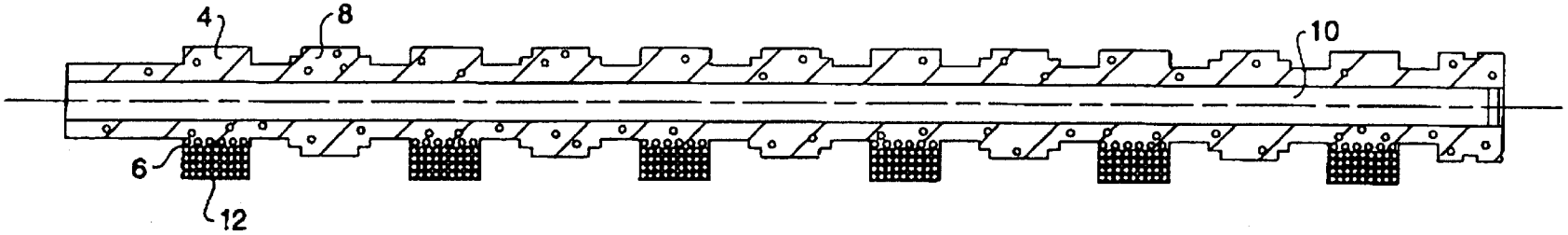
FIG. 2 shows a cut-away view of the camshaft of FIG. 1 along line 2—2.

Referring to FIG. 2, the camshaft 1 includes an axially oriented hollow interior portion 10. The shaft 2 is preferably composed of steel or cast iron in combination with wear resistant material (e.g., particles) 12. The wear resistant material 12 is distributed throughout the camshaft 1, and more preferably on an outer surface of each lobe 6. The wear resistant material 12 may also be distributed in the journal bearings 8 and, to an extent, throughout the shaft 1.

The wear resistant material 12 is preferably a carbide material such as tungsten carbide particles approximately 50 microns in size. The wear resistant material may also be ferro-tungsten/titanium carbide approximately 5 microns in size. When using these carbide materials, it is preferable to use cast iron for the base material of the camshaft 1 due to the high content of carbon within the cast iron. (The melting temperature of cast iron allows the carbon within the carbide material to remain therein and is not sacrificed thus allowing the carbide wear resistant material to retain its integrity during the casting process.)

It should be recognized by those of skill in the art that other materials and particle sizes may also be used with the present invention, depending on the particular application used with the camshaft 1. However, the wear resistant material 12 used for the lobe 6 should be a wear resistant material that has a higher density than the base material used for the shaft 2 (and other components). The high density has been found to be beneficial and relevant since during the manufacturing process the centripetal force causes the denser material to flow to the outside. These materials may include carbide materials, ceramic or diamond material. The wear resistant material 12 should also have a higher melting point than the base material.

The wear resistant material 12 is approximately 20% to 40% of volume (in relation to the base material) on the surface of the lobe 6. This same percentage volume may also be provided on the surface of the journal bearings 8. The percentage volume of the wear resistant particles gradually decreases to zero on the inside of shaft 2; that is, the surface of the hollow interior portion 12 is depleted of the wear resistant material 12.

Figure 1:
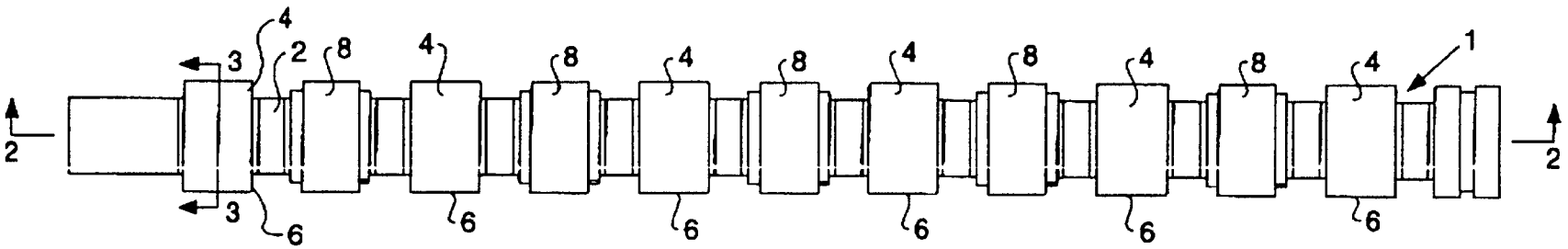
FIG. 1 shows a diagrammatic front plan view of the camshaft of the present invention.
Figure 3:
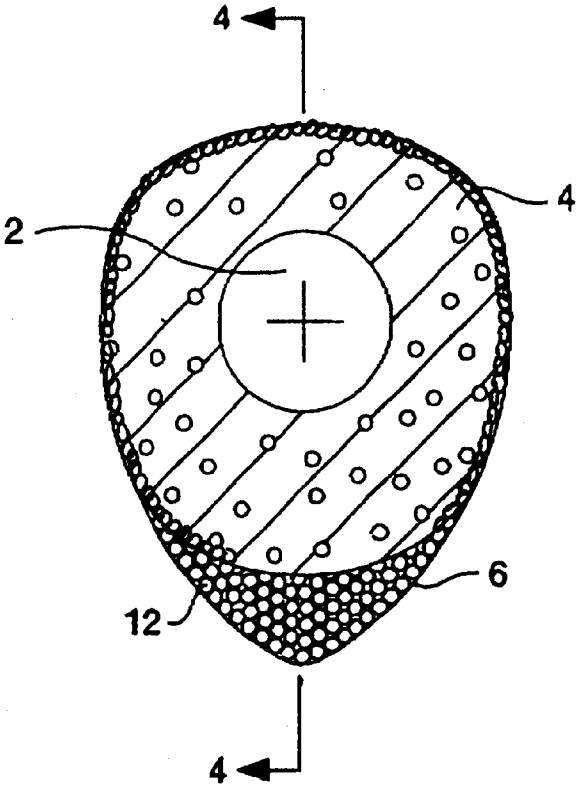
FIG. 3 shows a cut-away view of the camshaft of FIG. 1 along line 3—3.

FIG. 3 shows a cut-away view along line 3—3 of FIG. 1. FIG. 3 shows the wear resistant material 12 mainly at the lobe 6 of the cam 4, and preferably on an outer surface of the lobe 6. It should be understood that the wear resistant material 12 is preferably incorporated into the iron or steel (or other base material) on at least the surface of the lobe 6 to ensure that added wear resistance is provided at such location, although the wear resistant material 12 is also distributed throughout the lobe 6 and cam 4, itself.

Figure 4:
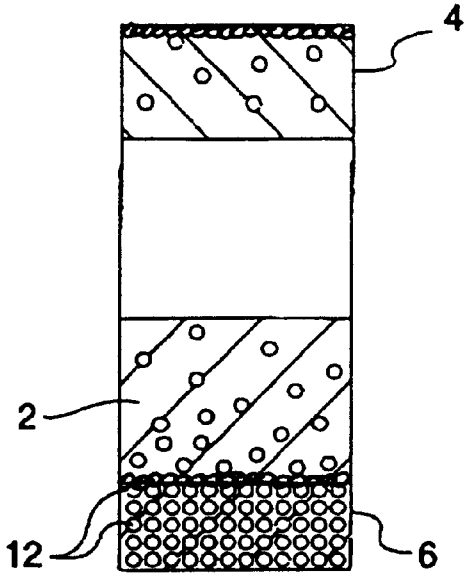
FIG. 4 shows a cut-away view of the lobe of FIG. 3 along line 4—4.

FIG. 4 shows a front plan view of the cam 4 of FIG. 3. It is seen that the wear resistant material 12 is concentrated on the surface of the lobe 6. The wear resistant material 12 may also be provided throughout the cam 4, but preferably in lesser quantities.

Figure 5:
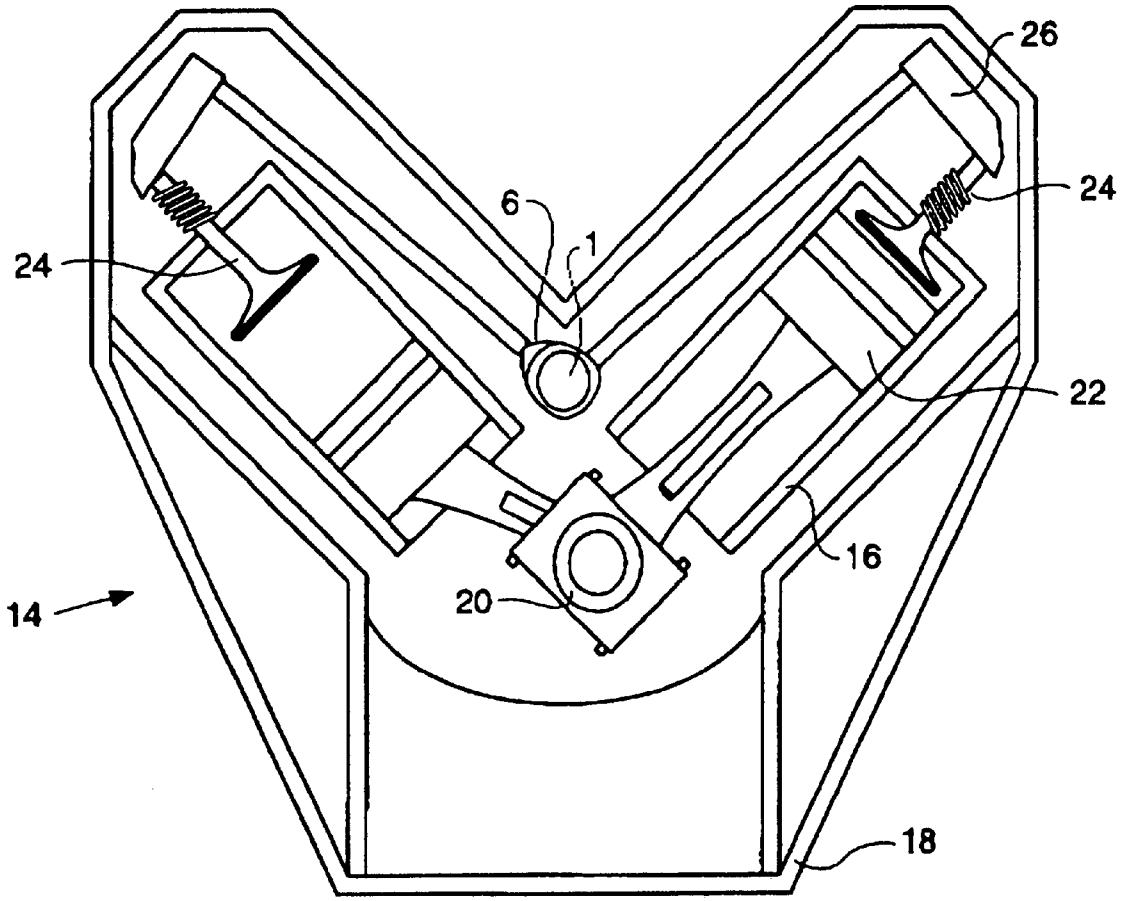
FIG. 5 shows a schematic view of the camshaft of the present invention used in an internal combustion engine.

FIG. 5 shows the camshaft 1 used in an internal combustion engine 14. The internal combustion engine 14 of FIG. 3 works in a manner well known to those skilled in the art; however, the internal combustion engine has an increased efficiency due to the use of the camshaft 1. In particular, the internal combustion engine 14 includes a cylinder 16 machined within a cylinder block 18, and a crankshaft 20 connected to a piston assembly 22 located within the cylinder 16. Intake and exhaust valves (e.g., valve assembly) 24 communicate with the cylinder 16, which are opened via a rocker arm assembly 26 in contact with the lobe 6 of the camshaft 1.

INDUSTRIAL APPLICABILITY

The camshaft 1 is used in an internal combustion engine 14. The hollow interior portion 10 of the camshaft reduces the weight of the camshaft 1 which, in turn, increases the efficiency of the internal combustion engine 14. The shaft 2 is composed of steel or cast iron in combination with the wear resistant material 12. The distribution of the wear resistant material 12 within at least the lobe 6 also ensures that the lobe 6, in particular, does not wear due to high contact stress from extensive friction during the use of the internal combustion engine 14.

The wear resistant material 12 has a higher density than the base material used for the shaft 2 (and other components). Ideally, the shaft 2 is manufactured by a centripetal casting process which allows the wear resistant material to migrate to the outer surface of the lobe 6 (and the other parts of the camshaft 1) during the manufacturing process thus ensuring added wear resistance at the lobe 6 region during the use of the internal combustion engine 14.

Other aspects, objects and advantages of this invention can be obtained from a study of the drawings, the disclosure and the appended claims.

What is claimed is:

1. A camshaft comprising:

a shaft being made of a base material;

a cam located on the shaft, the cam being made from the base material;

lobe projecting from the cam, the lobe being partly composed of the base material and having an outer surface; and a wear resistant material distributed on the outer surface of the lobe and uniformly incorporated into the base material on the outer surface and other portions of the lobe.

2. The camshaft of claim 1, wherein the wear resistant material is selected from the group consisting of tungsten carbide and ferrotungsten/titanium carbide.

3. The camshaft of claim 2, wherein the shaft is composed of one of steel and cast iron.

4. The camshaft of claim 2, wherein the tungsten carbide includes particles approximately 50 microns in size and the ferro-tungsten/titanium carbide includes particles approximately 5 microns in size.

5. The camshaft of claim 2, including a percentage volume of the wear resistant material of approximately 20% to 40% by volume on the outer surface of the lobe.

6. The camshaft of claim 5, wherein the percentage volume of the wear resistant material is less than 20% in the shaft.

7. The camshaft of claim 5, wherein the percentage volume of the wear resistant material decreases to zero in the shaft.

8. The camshaft of claim 1, including a hollow center interior portion within the shaft.

9. The camshaft of claim 1, wherein the wear resistant material is denser than the base material.

10. The camshaft of claim 9, wherein the wear resistant material has a higher melting point temperature than the base material.

11. The camshaft of claim 9, wherein the wear resistant material is a carbide based material and the base material is cast iron.

12. The camshaft material of claim 1, wherein the wear resistant material is one of ceramic and diamond material.

13. A camshaft composed of a base material, comprising:

a shaft having a length and composed of the base material;

a cam located along a portion of the length of the shaft;

a lobe extending from the cam; and a wear resistant material uniformly incorporated into the base material on the outer surface and other portions of the lobe, the wear resistant material being concentrated at the lobe and denser than the base material.

14. The camshaft of claim 13, wherein the wear resistant material has a higher melting point temperature than the base material.

15. The camshaft of claim 13, wherein the wear resistant material is a carbide based material and the base material is cast iron.

16. The camshaft of claim 13, wherein the carbide based material is one of a tungsten carbide and a ferro-tungsten/titanium carbide.

17. The camshaft material of claim 13, wherein the wear resistant material is one of ceramic and diamond material.

18. An internal combustion engine, comprising:

a cylinder block;

a cylinder bored in the cylinder block;

a piston assembly located within the cylinder;

a crankshaft connected to the piston assembly;

a valve assembly communicating with the cylinder; and a camshaft for opening the valve assembly, the camshaft being composed of a base material and comprising, a shaft having a length;

a cam located at a position along the length of the shaft;

a lobe extending from the cam, the lobe having an outer surface; and a wear resistant material on the outer surface of the lobe and being incorporated uniformly with the base material on the outer surface and other portions of the lobe, the wear resistant material being more dense than the base material.

19. The internal combustion engine of claim 18, wherein the wear resistant material is one of tungsten carbide and ferro-tungsten/titanium carbide.

20. The internal combustion engine of claim 18, wherein the wear resistant material has a higher melting point temperature than the base material.

* * * * *